US011688340B2

(12) United States Patent
Zhu et al.

(10) Patent No.: US 11,688,340 B2
(45) Date of Patent: Jun. 27, 2023

(54) GAMMA DEBUGGING METHOD AND APPARATUS

(71) Applicants: Chengdu BOE Optoelectronics Technology Co., Ltd., Sichuan (CN); BOE Technology Group Co., Ltd., Beijing (CN)

(72) Inventors: Yuanzhang Zhu, Beijing (CN); Guoqiang Wu, Beijing (CN); Ting Han, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/797,830

(22) PCT Filed: Oct. 22, 2021

(86) PCT No.: PCT/CN2021/125810
§ 371 (c)(1),
(2) Date: Aug. 5, 2022

(87) PCT Pub. No.: WO2022/100416
PCT Pub. Date: May 19, 2022

(65) Prior Publication Data

US 2023/0058388 A1 Feb. 23, 2023

(30) Foreign Application Priority Data

Nov. 10, 2020 (CN) ..... 202011245631.1

(51) Int. Cl.
*G09G 3/3225* (2016.01)
*G09G 3/20* (2006.01)

(52) U.S. Cl.
CPC ..... *G09G 3/3225* (2013.01); *G09G 3/2074* (2013.01); *G09G 2320/0276* (2013.01); *G09G 2320/0693* (2013.01)

(58) Field of Classification Search
CPC ..... G09G 3/003; G09G 3/3426; G09G 5/14; G09G 2320/0276; G09G 2320/045;
(Continued)

(56) References Cited

U.S. PATENT DOCUMENTS

2008/0088548 A1 4/2008 Lee et al.
2008/0284694 A1 11/2008 Dunn
(Continued)

FOREIGN PATENT DOCUMENTS

CN 107665666 A 2/2018
CN 107731148 A 2/2018
(Continued)

OTHER PUBLICATIONS

CN 202011245631.1 first office action.
PCT/CN2021/125810 international search report and written opinion.

*Primary Examiner* — Shaheda A Abdin
(74) *Attorney, Agent, or Firm* — IPro, PLLC

(57) ABSTRACT

A gamma debugging method and a gamma debugging apparatus are provided. The gamma debugging method includes: selecting a test display region in a first display region, performing gamma debugging on test sub-pixels to obtain a first gamma data set; controlling all sub-pixels in the test display region and all sub-pixels in a second display region to emit light, and detecting a target luminance and a target chrominance of the test display region that correspond to a corresponding grayscale; performing gamma debugging on the second display region to obtain a second gamma data set; obtaining, based on the second gamma data set, the first
(Continued)

gamma data set and the predetermined gamma data set, a third gamma data set applied to the second display region.

9 Claims, 6 Drawing Sheets

(58) Field of Classification Search
CPC ..... G09G 2320/0626; G09G 2320/029; G09G 2360/16; G09G 2320/043; G09G 2320/06; G09G 2320/0693; G02B 27/017
See application file for complete search history.

(56) References Cited

U.S. PATENT DOCUMENTS

| | | | | |
|---|---|---|---|---|
| 2017/0140711 | A1* | 5/2017 | Zhang | G09G 3/003 |
| 2019/0130844 | A1 | 5/2019 | Yang et al. | |
| 2020/0135147 | A1 | 4/2020 | Tang et al. | |
| 2021/0056918 | A1 | 2/2021 | Li et al. | |
| 2022/0301482 | A1 | 9/2022 | Wang et al. | |

FOREIGN PATENT DOCUMENTS

| | | | |
|---|---|---|---|
| CN | 109637475 | A | 4/2019 |
| CN | 110444178 | A | 11/2019 |
| CN | 110599957 | A | 12/2019 |
| CN | 110634434 | A | 12/2019 |
| CN | 111445859 | A | 7/2020 |
| CN | 111833791 | A | 10/2020 |
| CN | 111833793 | A | 10/2020 |
| CN | 111862875 | A | 10/2020 |
| CN | 112365845 | A | 2/2021 |

* cited by examiner

| | | |

GAMMA DEBUGGING METHOD AND APPARATUS

CROSS-REFERENCE TO RELATED APPLICATION

This application is the U.S. national phase of PCT Application No. PCT/CN2021/125810 filed on Oct. 22, 2021, which claims a priority to the Chinese patent application No. 202011245631.1 filed in China on Nov. 10, 2020, the disclosures of which are incorporated herein by reference in their entireties.

TECHNICAL FIELD

The present disclosure relates to the field of gamma debugging technology, in particular to a gamma debugging method and a gamma debugging apparatus.

BACKGROUND

For a conventional active-matrix organic light-emitting diode (AMOLED) display apparatus, gamma debugging is an essential engineering process before shipment. This process concerns how good the optical display characteristics of a shipped display apparatus are, and the quality of gamma curve directly determines the display quality. Therefore, all panel manufacturers now uphold strict standards for gamma debugging of shipped display apparatuses. In AMOLED display apparatus applications in the related art, the arrangement manner of pixels in an active display region of a display apparatus remains constant, so gamma debugging will only be performed on the central region of the active display region of the display apparatus. However, with the development of new display apparatus, a structure that has two or more kinds of pixel arrangement modes in the active display region of a single display apparatus appears. Since there are display regions with different pixel arrangements, the display pixels per inch (PPI) (pixel density) is also different in the regions, and conventional gamma debugging methods can no longer meet the requirements of these new display apparatuses.

SUMMARY

In a first aspect, a gamma debugging method applied to a display panel is provided according to an embodiment of the present disclosure, wherein the display panel includes a first display region and a second display region, and the second display region has a lower pixel density than that of the first display region. The method including:

obtaining a predetermined gamma data set of the first display region;

selecting a test display region in the first display region, taking part of sub-pixels in the test display region as test sub-pixels, and performing gamma debugging on the test sub-pixels to obtain a first gamma data set, where the test sub-pixels positionally correspond to sub-pixels in the second display region;

controlling all the sub-pixels in the test display region and all the sub-pixels in the second display region to emit light, and detecting a target luminance and a target chrominance of the test display region that correspond to a corresponding grayscale;

performing gamma debugging on the second display region, such that at the corresponding grayscale, a luminance of the second display region is the target luminance, and a chrominance of the second display region is the target chrominance, and obtaining a second gamma data set; and obtaining, based on the second gamma data set, the first gamma data set and the predetermined gamma data set, a third gamma data set applied to the second display region.

Optionally, the performing gamma debugging on the test sub-pixels to obtain a first gamma data set, including:

controlling the test sub-pixels to light up, and controlling sub-pixels in the test display region other than the test sub-pixels not to emit light; and adjusting analog data voltages provided to the test sub-pixels to perform gamma debugging on the test display region to obtain the first gamma data set.

Optionally, according to at least one embodiment of the present disclosure, the method further including:

while controlling all the sub-pixels in the test display region to emit light, controlling all the sub-pixels in other regions of the first display region than the test display region to emit light.

Optionally, the maximum distance between an outer edge of the test display region and an outer edge of the second display region is less than a predetermined distance.

Optionally, the obtaining, based on the second gamma data set, the first gamma data set and the predetermined gamma data set, the third gamma data set applied to the second display region, including:

obtaining a difference gamma data set based on the second gamma data set and the first gamma data set; and obtaining, based on the difference gamma data set and the predetermined gamma data set, the third gamma data set applied to the second display region.

Optionally, before the obtaining the predetermined gamma data set of the first display region, the gamma debugging method further including:

performing gamma debugging on the sub-pixels in the first display region to obtain the predetermined gamma data set.

In a second aspect, a gamma debugging apparatus applied to a display panel is also provided according to an embodiment of the present disclosure, wherein the display panel includes a first display region and a second display region, and the second display region has a lower pixel density than that of the first display region. The gamma debugging apparatus includes an obtaining module, a debugging module, a detecting module and a processing module, wherein the obtaining module is configured to obtain a predetermined gamma data set of the first display region;

the debugging module is configured to perform gamma debugging on the test sub-pixels in a test display region selected in the first display region to obtain a first gamma data set, wherein the test sub-pixels positionally correspond to sub-pixels in the second display region, and the test sub-pixels are part of sub-pixels in the test display region;

the detecting module is configured to control all the sub-pixels in the test display region and all the sub-pixels in the second display region to emit light, and detect a target luminance and a target chrominance of the test display region that correspond to a corresponding grayscale;

the debugging module is further configured to perform gamma debugging on the second display region, such that at the corresponding grayscale, a luminance of the second display region is the target luminance, and a chrominance of the second display region is the target chrominance, and to obtain a second gamma data set;

the processing module is configured to obtain, based on the second gamma data set, the first gamma data set and the predetermined gamma data set, a third gamma data set applied to the second display region.

Optionally, the debugging module is specifically configured to control the test sub-pixels to light up, and control sub-pixels in the test display region other than the test sub-pixels not to emit light, and adjust analog data voltages provided to the test sub-pixels to perform gamma debugging on the test display region to obtain the first gamma data set.

Optionally, the detecting module is further configured to control all the sub-pixels in other regions of the first display region than the test display region to emit light while controlling all the sub-pixels in the test display region to emit light.

Optionally, the processing module is specifically configured to obtain a difference gamma data set based on the second gamma data set and the first gamma data set; and obtain, based on the difference gamma data set and the predetermined gamma data set, the third gamma data set applied to the second display region.

Optionally, the debugging module is further configured to perform gamma debugging on the sub-pixels in the first display region to obtain the predetermined gamma data set.

BRIEF DESCRIPTION OF THE DRAWINGS

FIG. 3 is a schematic view of a pixel arrangement of a first display region according to at least one embodiment;

DETAILED DESCRIPTION

The present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Figure 1:
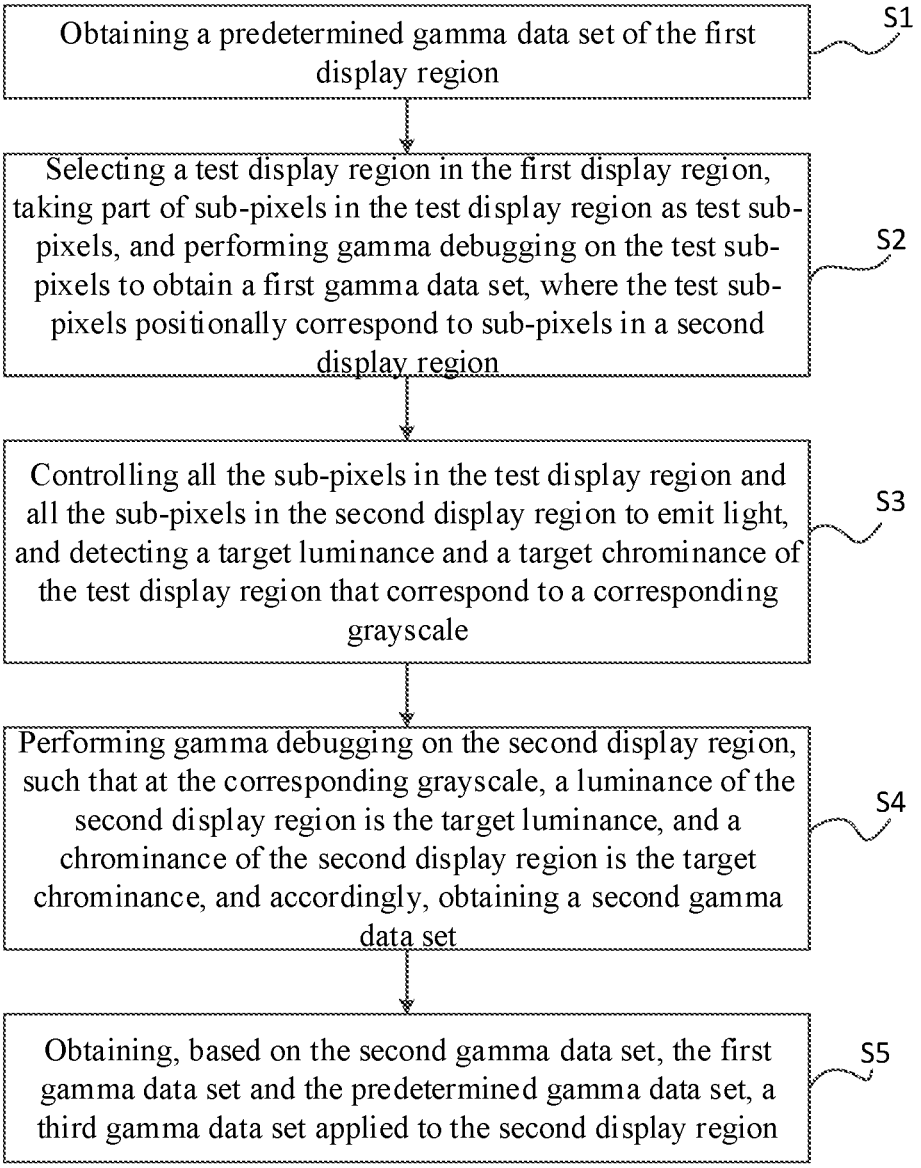
FIG. 1 is a flow chart of a gamma debugging method according to at least one embodiment of the present disclosure.

The gamma debugging method according to at least one embodiment of the present disclosure is applied to a display panel. The display panel includes a first display region and a second display region, and the second display region has a lower pixel density than that of the first display region. As shown in FIG. 1, the gamma debugging method includes following steps:

S1: obtaining a predetermined gamma data set of the first display region;

S2: selecting a test display region in the first display region, taking part of sub-pixels in the test display region as test sub-pixels, and performing gamma debugging on the test sub-pixels to obtain a first gamma data set, where the test sub-pixels positionally correspond to sub-pixels in the second display region;

S3: controlling all the sub-pixels in the test display region and all the sub-pixels in the second display region to emit light, and detecting a target luminance and a target chrominance of the test display region that correspond to a corresponding grayscale;

S4: performing gamma debugging on the second display region, such that at the corresponding grayscale, a luminance of the second display region is the target luminance, and a chrominance of the second display region is the target chrominance, and accordingly, obtaining a second gamma data set;

S5: obtaining, based on the second gamma data set, the first gamma data set and the predetermined gamma data set, a third gamma data set applied to the second display region.

The gamma debugging method according to at least one embodiment of the present disclosure is capable of obtaining, based on the predetermined gamma data set of the first display region, the third gamma data set applied to the second display region.

The gamma debugging method according to at least one embodiment of the present disclosure is capable of performing gamma debugging for display apparatus including display regions with different pixel arrangements, without accurately aligning the second display region, so as to adjust gamma characteristics of different display regions, so that when the display apparatus operates normally, display information (the display information may include luminance and chrominance, but is not limited thereto) of the first display region is substantially the same as display information of the second display region at the same grayscale.

In practical operation, the area of the second display region may be relatively small, and therefore if the gamma optical probe is used to detect the luminance and the chrominance of the second display region each time, accurate alignment is required, which is difficult. With the gamma debugging method according to at least one embodiment of the present disclosure, a difference gamma data set between the second gamma data set and the first gamma data set can be obtained in a laboratory (the specific method for obtaining the difference gamma data set is described later), and then only the predetermined gamma data set applied to the first display region needs to be detected, i.e., the third gamma data set applied to the second display region can be obtained based on the predetermined gamma data set and the difference gamma data set.

In at least one embodiment of the present disclosure, when the grayscale of a sub-pixel ranges from 0 to 255, the aforementioned corresponding grayscale may be, but is not limited to, 0, 255, and each grayscale value between 0 and 255.

In the gamma debugging method according to at least one embodiment of the present disclosure, the predetermined gamma data set of the first display region can be detected in advance, then the test display region is selected from the first display region, and gamma debugging is performed on the test sub-pixels in the test display region so as to obtain the first gamma data set; where the positions of the test sub-pixels correspond to the positions of the sub-pixels in the second display region.

Thereafter, all the sub-pixels in the test display region and all the sub-pixels in the second display region are controlled to emit light, and a luminance and a chrominance of the test display region that correspond to the corresponding grayscale are detected (in at least one embodiment of the present disclosure, the luminance and the chrominance of the test display region that correspond to the corresponding grayscale refer to, but are not limited to: the luminance of the test display region and the chrominance of the test display region when all the test sub-pixels in the test display region are at the corresponding grayscale), where the luminance is the target luminance and the chrominance is the target chrominance. At this time, at the same grayscale, the luminance of the test display region is higher than that of the second display region, but is not limit thereto.

After the target luminance and the target chrominance are detected and obtained, gamma debugging is performed on the second display region, such that at the corresponding grayscale, the luminance of the second display region is the target luminance, the chrominance of the second display region is the target chrominance (that is, at a first grayscale, the luminance of the second display region is a first target luminance and the chrominance of the second display region is a first target chrominance; at a second grayscale, the luminance of the second display region is a second target luminance and the chrominance of the second display region is a second target chrominance; furthermore, in at least one embodiment of the present disclosure, that the luminance of the second display region is the target luminance and the chrominance of the second display region is the target chrominance at the corresponding grayscale refers to, but is not limited to: the luminance of the second display region is the target luminance and the chrominance of the second display region is the target chrominance when all the sub-pixels in the second display region are at the corresponding grayscale; in at least one embodiment of the present disclosure, that the sub-pixels are at the corresponding grayscale refers to: grayscale values of the sub-pixels are the corresponding grayscale value, for example, a sub-pixel is at a grayscale of 255, i.e., the grayscale value of the sub-pixel is 255), and thereby the second gamma data set is obtained.

After the second gamma data set is obtained, the third gamma data set applied to the second display region is obtained based on the second gamma data set, the first gamma data set and the predetermined gamma data set.

In at least one embodiment of the present disclosure, analog data voltages, corresponding to respective grayscales, provided to the respective sub-pixels in the first display region are recorded in the predetermined gamma data set, such that the luminance of the first display region can reach a desired luminance and the chrominance of the first display region can reach a desired chrominance. For example, when red sub-pixels, green sub-pixels, and blue sub-pixels are provided in the test display region, at the same grayscale, a first analog data voltage may correspond to the red sub-pixels, a second analog data voltage may correspond to the green sub-pixels, and a third analog data voltage may correspond to the blue sub-pixels, and the first analog data voltage, the second analog data voltage, and the third analog data voltage may not be equal, but the present disclosure is not limited thereto.

In practical operation, the desired luminance can be obtained according to a preset maximum luminance corresponding to the maximum grayscale and a gamma curve with a gamma value of 2.2, but the present disclosure is not limited thereto.

In a specific implementation, analog data voltages to be supplied to the sub-pixels in the second display region at corresponding grayscales are recorded in the third gamma data set, such that at the same grayscale, the luminance of the second display region is substantially the same as the luminance of the test display region, and the chrominance of the second display region is substantially the same as the chrominance of the test display region.

In at least one embodiment of the present disclosure, that the positions of the test sub-pixels correspond to the positions of the sub-pixels in the second display region refers to: if in the second display region, a sub-pixel is provided at the $N^{th}$ row and $M^{th}$ column, and no sub-pixel is provided at the $A^{th}$ row and $B^{th}$ column, then in the test display region, the sub-pixel at the $N^{th}$ row and $M^{th}$ column is selected as a test sub-pixel; the sub-pixel at the $N^{th}$ row and $M^{th}$ column is controlled to emit light, and the sub-pixel at the $A^{th}$ row and $B^{th}$ column is controlled not to emit light; where M, N, A and B are all positive integers.

The performing gamma debugging on the test sub-pixels in the test display region to obtain the first gamma data set refers to: when all the test sub-pixels are controlled to emit light, and other sub-pixels in the test display region than the test sub-pixels are controlled not to emit light, and when the same grayscale is provided to all the test sub-pixels (for example, the grayscale can range from 0 to 255, but is not limited thereto), the analog data voltages provided to the test sub-pixels are adjusted, so that the luminance of the test display region is the desired luminance and the chrominance of the test display region is the desired chrominance, and the analog data voltages corresponding to the grayscale are recorded at this time, the analog data voltages being the first debugged analog data voltages, so as to obtain the first gamma data set; the first debugged analog data voltages for the corresponding grayscale are recorded in the first gamma data set; for example, when red sub-pixels, green sub-pixels, and blue sub-pixels are provided in the test display region, at the same grayscale, a first one of the first debugged analog data voltages may correspond to the red sub-pixels, a second one of the first debugged analog data voltages may correspond to the green sub-pixels, and a third one of the first debugged analog data voltages may correspond to the blue sub-pixels, and the first one of the first debugged analog data voltages, the second one of the first debugged analog data voltages and the third one of the first debugged analog data voltages may not be equal, but the present disclosure is not limited thereto.

In the gamma debugging method according to at least one embodiment of the present disclosure, in step S3, when the sub-pixels in the test display region and all the sub-pixels in the second display region are controlled to emit light, the gamma data set provided to the sub-pixels in the test display region is the predetermined gamma data set (that is, at the corresponding grayscale, the analog data voltages provided to respective sub-pixels in the test display region are analog data voltages in the predetermined gamma data set), and the gamma data set provided to the sub-pixels in the second display region is the first gamma data set (that is, at the corresponding grayscale, the analog data voltages provided to respective sub-pixels in the second display region are the analog data voltages in the first gamma data set), but the present disclosure is not limited thereto.

In at least one embodiment of the present disclosure, in step S4, the performing gamma debugging on the second display region may refer to: at the same grayscale, adjusting the analog data voltages of the sub-pixels in the second display region to second debugged analog data voltages, so that the luminance of the second display region reaches the target luminance and the chrominance of the second display region reaches the target chrominance, to obtain the second gamma data set. In the second gamma data set, the second debugged analog data voltages for the corresponding grayscale are recorded. For example, when red sub-pixels, green sub-pixels, and blue sub-pixels are provided in the test display region, at the same grayscale, a first one of the second debugged analog data voltages may correspond to the red sub-pixels, a second one of the second debugged analog data voltages may correspond to the green sub-pixels, and a third one of the second debugged analog data voltages may correspond to the blue sub-pixels, and the first one of the second debugged analog data voltages, the second one of the second debugged analog data voltages and the third one of the second debugged analog data voltages may not be equal, but the present disclosure is not limited thereto.

Also, before performing gamma debugging on the second display region, the gamma data set provided to the second display region may be the first gamma data set, but the present disclosure is not limited thereto.

In at least one embodiment of the present disclosure, in step S4, performing gamma debugging on the second display region and adjusting the values of analogue data voltages corresponding to corresponding grayscale in a gamma data set applied to the second display region are not limited to using a manner of sending data by a driving integrated circuit (IC) alone or a manner of external compensation so that the luminance of the test display region is consistent with the luminance of the second display region at all grayscales, and the chrominance of the test display region is consistent with the chrominance of the second display region at all grayscales.

In a specific implementation, the obtaining, based on the second gamma data set, the first gamma data set and the predetermined gamma data set, the third gamma data set applied to the second display region may include:

obtaining a difference gamma data set based on the second gamma data set and the first gamma data set; and obtaining, based on the difference gamma data set and the predetermined gamma data set, the third gamma data set applied to the second display region.

Optionally, the obtaining, based on the difference gamma data set and the predetermined gamma data set, the third gamma data set applied to the second display region may include:

adding the analog data voltages corresponding to the corresponding grayscale in the predetermined gamma data set to the analog data voltages corresponding to the corresponding grayscale in the difference gamma data set, to obtain the analog data voltages corresponding to the corresponding grayscale in the third gamma data set.

After obtaining the first gamma data set and the second gamma data set, by comparing the first gamma data set with the second gamma data set, a linear relationship between the data in the first gamma data set and the data in the second gamma data set can be found, and by performing multiple tests on the display apparatuses of the same batch, a difference gamma data set between the second gamma data set and the first gamma data set can be obtained, where the difference gamma data set can be copied and referred to in each display apparatus, and is output in a region-wise manner to the first display region and the second display region through the data adjustment of the driving IC, such that the first display region and the second display region have the same display effect. In addition, the gamma debugging method according to at least one embodiment of the present disclosure only uses one gamma debugging device, and obtains the difference gamma data set by looking for a value multiple times, where the difference gamma data set can be applied to most display apparatuses and facilitates a high mass production performance.

In at least one embodiment of the present disclosure, in case that multiple tests are performed on N display apparatuses (N is an integer greater than 1) of the same batch, the difference gamma data set between the second gamma data set and the first gamma data set may be obtained through following manners:

a first manner: for each display apparatus to be tested, subtracting the analog data voltages corresponding to each grayscale in the first gamma data set from the analog data voltages corresponding to the grayscale in the second gamma data set, to obtain the analog data voltages corresponding to the grayscale in a to-be-averaged difference gamma data set; adding analog data voltages corresponding to the corresponding grayscale in a plurality of to-be-averaged difference gamma data sets, and taking an average value, to obtain the analog data voltages corresponding to the corresponding grayscale in the difference gamma data set, thereby obtaining the difference gamma data set;

a second manner: according to a pre-set algorithm, processing the analogue data voltages corresponding to corresponding grayscale in a first gamma data set and a second gamma data set of the N display apparatuses, to obtain the analogue data voltages corresponding to the corresponding grayscale in the difference gamma data set, thereby obtaining the difference gamma data set;

but the present disclosure is not limited to the above two manners.

In at least one embodiment of the present disclosure, the second display region may be a display region provided with an under-screen camera, and the first display region may be a normal display region, but the present disclosure is not limited thereto.

In the related art, with the diversified development of display apparatuses, an active display region of a display panel in a display apparatus has display regions with a plurality of pixel arrangements. For example, the active display region can include a first display region and a second display region, where an under-screen camera is provided below the second display region of the display panel, and the region above the under-screen camera is transparent through panel design, so that the pixels per inch (PPI, pixel density) of the second display region is half the PPI of the first display region (but the present disclosure is not limited thereto), so as to enable a bezel-less screen.

Figure 2:
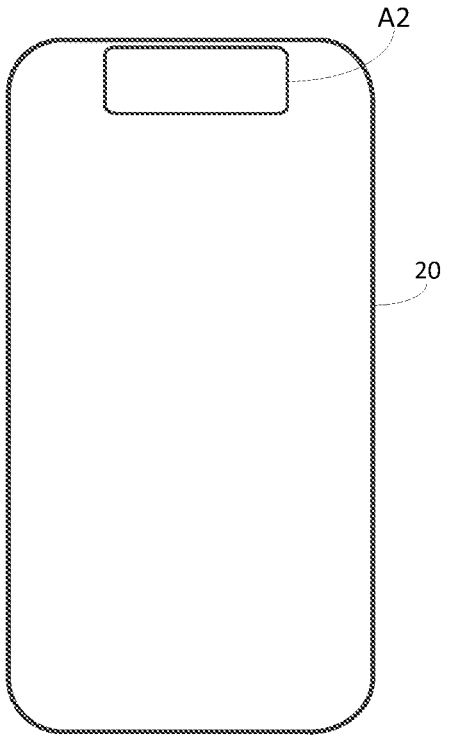
FIG. 2 is a schematic view of an active display region of a display panel according to at least one embodiment.

As shown in FIG. 2, an active display region 20 of the display panel includes a first display region and a second display region A2, where the first display region is a normal display region, and A2 is a display region provided with an under-screen camera; the first display region is a region of the active display region 20 other than A2.

The second display region A2 and the first display region in FIG. 2 are for example only, and are not intended to limit the shape and position of each display region.

In a specific implementation, the test display region may be square or circular in shape, but the present disclosure is not limited thereto.

According to one specific implementation, in the first display region, the pixel arrangement may be as shown in FIG. 3. In FIG. 3, red sub-pixels are labeled R, green sub-pixels are labeled G, and blue sub-pixels are labeled B.

Figure 4:
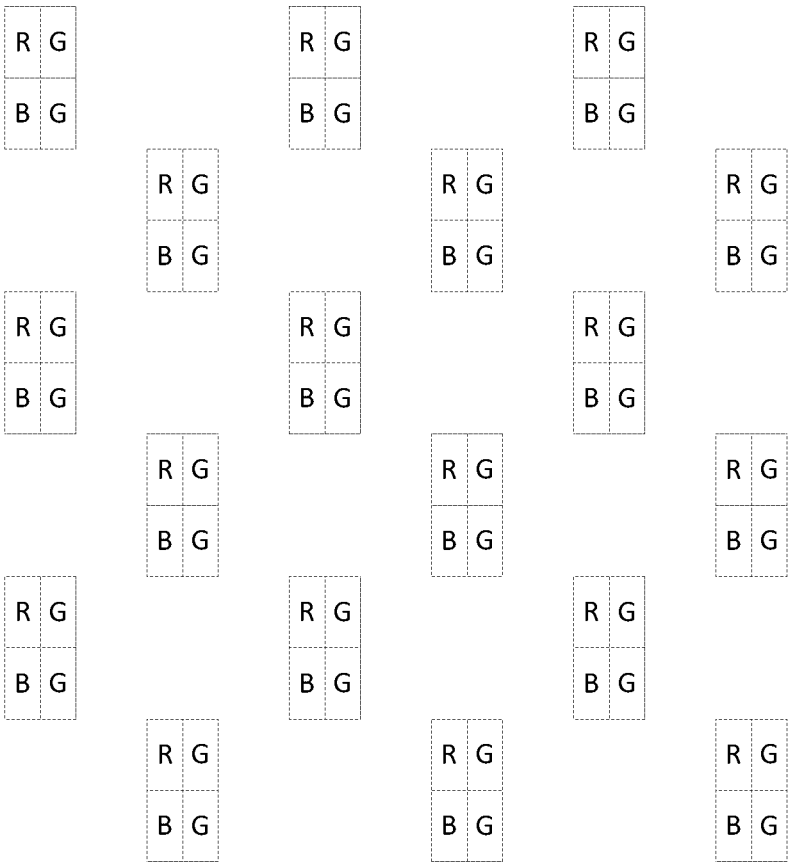
FIG. 4 is a schematic view of a pixel arrangement of a second display region according to at least one embodiment.

In the second display region, the pixel arrangement may be as shown in FIG. 4. In FIG. 4, red sub-pixels are labeled R, green sub-pixels are labeled G, and blue sub-pixels are labeled B.

As can be seen by comparing FIG. 3 and FIG. 4, the pixel density of the second display region is lower than the pixel density of the first display region.

In FIG. 4, sub-pixels are provided at (row 1, column 1), (row 1, column 2), (row 1, column 9), (row 1, column 10), (row 1, column 17) and (row 1, column 18);

sub-pixels are provided at (row 2, column 1), (row 2, column 2), (row 2, column 9), (row 2, column 10), (row 2, column 17) and (row 2, column 18);

sub-pixels are provided at (row 3, column 5), (row 3, column 6), (row 3, column 13), (row 3, column 14), (row 3, column 21) and (row 3, column 22);

sub-pixels are provided at (row 4, column 5), (row 4, column 6), (row 4, column 13), (row 4, column 14), (row 4, column 21) and (row 4, column 22);

sub-pixels are provided at (row 5, column 1), (row 5, column 2), (row 5, column 9), (row 5, column 10), (row 5, column 17) and (row 5, column 18);

sub-pixels are provided at (row 6, column 1), (row 6, column 2), (row 6, column 9), (row 6, column 10), (row 6, column 17) and (row 6, column 18);

sub-pixels are provided at (row 7, column 5), (row 7, column 6), (row 7, column 13), (row 7, column 14), (row 7, column 21) and (row 7, column 22);

sub-pixels are provided at (row 8, column 5), (row 8, column 6), (row 8, column 13), (row 8, column 14), (row 8, column 21) and (row 8, column 22);

sub-pixels are provided at (row 9, column 1), (row 9, column 2), (row 9, column 9), (row 9, column 10), (row 9, column 17) and (row 9, column 18);

sub-pixels are provided at (row 10, column 1), (row 10, column 2), (row 10, column 9), (row 10, column 10), (row 10, column 17) and (row 10, column 18);

sub-pixels are provided at (row 11, column 5), (row 11, column 6), (row 11, column 13), (row 11, column 14), (row 11, column 21) and (row 11, column 22);

sub-pixels are provided at (row 12, column 5), (row 12, column 6), (row 12, column 13), (row 12, column 14), (row 12, column 21) and (row 12, column 22).

In at least one embodiment of the present disclosure, the test display region is selected in the first display region shown in FIG. 3, and the positions of the test sub-pixels in the test display region correspond to the positions of the sub-pixels in the second display region.

Figure 5:
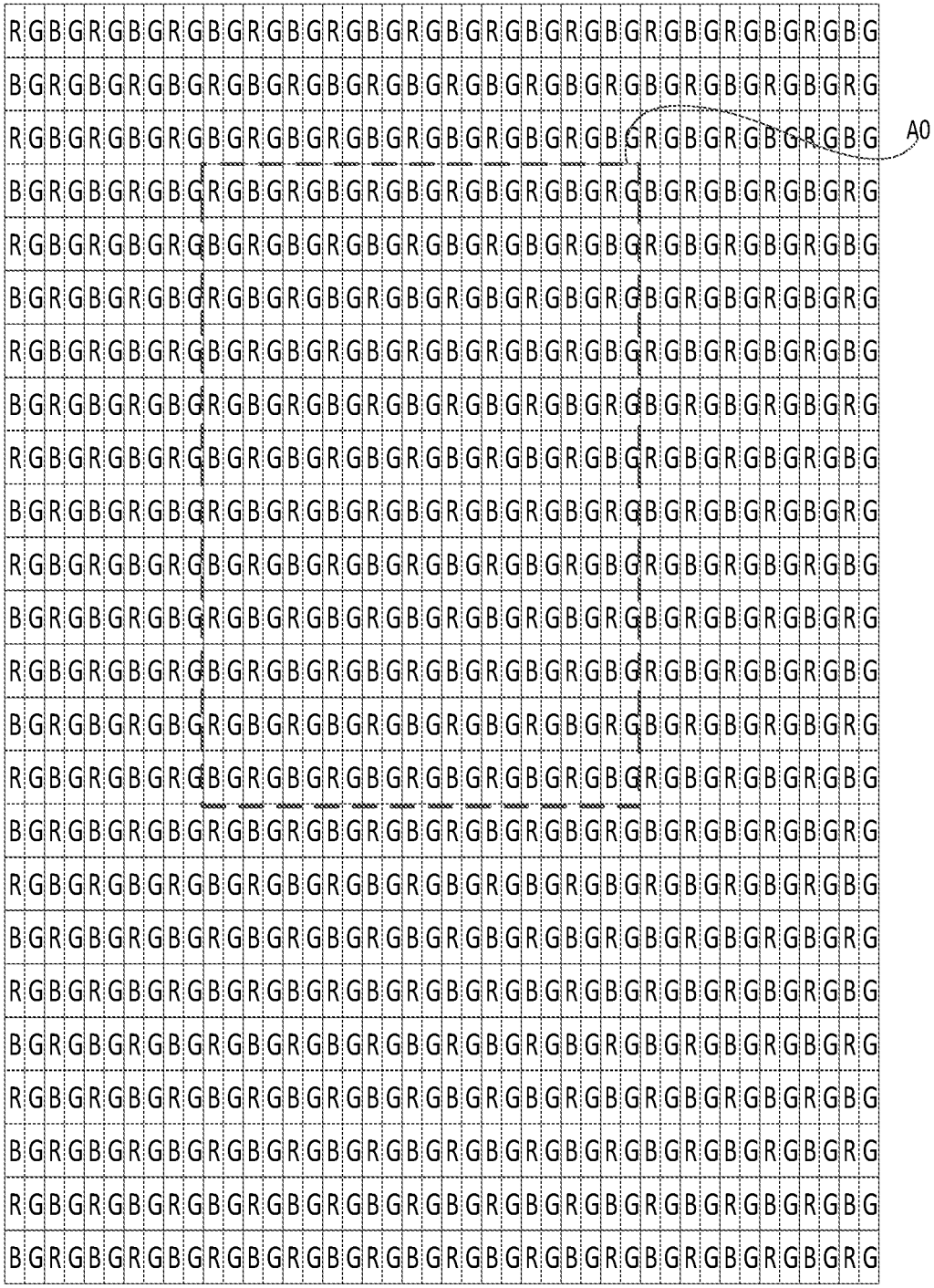
FIG. 5 is a schematic view of a test display region of the first display region.

That is, as shown in FIG. 5, AO is the test display region in the first display region, and the test sub-pixels in the test display region include:

sub-pixels at (row 1, column 1), (row 1, column 2), (row 1, column 9), (row 1, column 10), (row 1, column 17) and (row 1, column 18);

sub-pixels at (row 2, column 1), (row 2, column 2), (row 2, column 9), (row 2, column 10), (row 2, column 17) and (row 2, column 18);

sub-pixels at (row 3, column 5), (row 3, column 6), (row 3, column 13), (row 3, column 14), (row 3, column 21) and (row 3, column 22);

sub-pixels at (row 4, column 5), (row 4, column 6), (row 4, column 13), (row 4, column 14), (row 4, column 21) and (row 4, column 22);

sub-pixels at (row 5, column 1), (row 5, column 2), (row 5, column 9), (row 5, column 10), (row 5, column 17) and (row 5, column 18);

sub-pixels at (row 6, column 1), (row 6, column 2), (row 6, column 9), (row 6, column 10), (row 6, column 17) and (row 6, column 18);

sub-pixels at (row 7, column 5), (row 7, column 6), (row 7, column 13), (row 7, column 14), (row 7, column 21) and (row 7, column 22);

sub-pixels at (row 8, column 5), (row 8, column 6), (row 8, column 13), (row 8, column 14), (row 8, column 21) and (row 8, column 22);

sub-pixels at (row 9, column 1), (row 9, column 2), (row 9, column 9), (row 9, column 10), (row 9, column 17) and (row 9, column 18);

sub-pixels at (row 10, column 1), (row 10, column 2), (row 10, column 9), (row 10, column 10), (row 10, column 17) and (row 10, column 18);

sub-pixels at (row 11, column 5), (row 11, column 6), (row 11, column 13), (row 11, column 14), (row 11, column 21) and (row 11, column 22);

sub-pixels at (row 12, column 5), (row 12, column 6), (row 12, column 13), (row 12, column 14), (row 12, column 21) and (row 12, column 22).

Also, in practical operation, colours of the test sub-pixels may be the same as colours of the sub-pixels at the corresponding positions in the second display region, but the present disclosure is not limited thereto.

In at least one embodiment of the present disclosure, the performing gamma debugging on the test sub-pixels to obtain the first gamma data set may include:

controlling the test sub-pixels to light up, and controlling sub-pixels in the test display region other than the test sub-pixels not to emit light; and adjusting analog data voltages provided to the test sub-pixels to perform gamma debugging on the test display region, to obtain the first gamma data set.

In a specific implementation, the gamma debugging method according to at least one embodiment of the present disclosure may also include:

while controlling all the sub-pixels in the test display region to emit light, controlling all sub-pixels in other regions of the first display region than the test display region to emit light, that is, controlling all the sub-pixels in the first display region to emit light, so that the luminance and chrominance of edges within the test display region are uniform.

Optionally, the maximum distance between an outer edge of the test display region and an outer edge of the second display region is less than a predetermined distance (the predetermined distance may be selected according to circumstances).

In at least one embodiment of the present disclosure, the distance between the test display region and the second display region may be set to be close to each other.

In at least one embodiment of the present disclosure, before the obtaining the predetermined gamma data set of the first display region, the gamma debugging method may further include:

performing gamma debugging on the sub-pixels in the first display region to obtain the predetermined gamma data set.

Specifically, the luminance and chrominance of the first display region can be detected by a gamma optical probe, the first display region is controlled to display a grayscale picture, and the grayscale values provided to each sub-pixel in the first display region is the same, and at the corresponding grayscale (the corresponding grayscale can be 0, 255, and each grayscale value between 0 and 255, but the present disclosure is not limited thereto), the analog data voltages provided to the sub-pixels are adjusted so that the luminance of the first display region is the desired luminance and the chrominance of the first display region is a desired chrominance.

Figure 6:
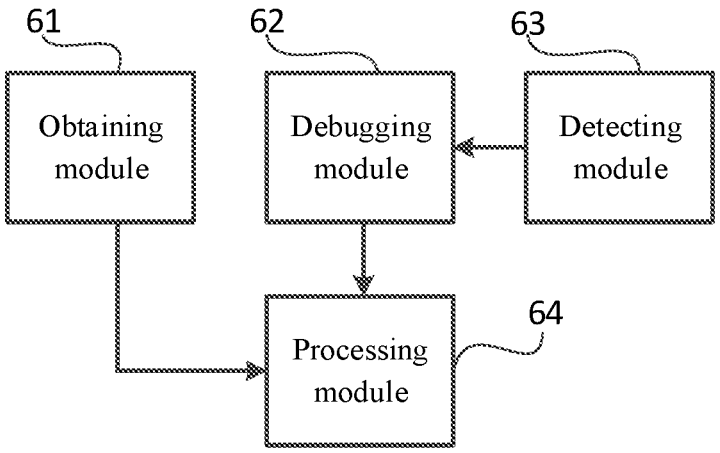
FIG. 6 is a structural schematic view of a gamma debugging apparatus according to at least one embodiment of the present disclosure.

The gamma debugging apparatus according to at least one embodiment of the present disclosure is applied to a display panel. The display panel includes a first display region and a second display region, and the second display region has a lower pixel density than that of the first display region. As shown in FIG. 6, the gamma debugging apparatus according to at least one embodiment of the present disclosure includes an obtaining module 61, a debugging module 62, a detecting module 63 and a processing module 64.

The obtaining module 61 is configured to obtain a predetermined gamma data set of the first display region.

The debugging module 62 is configured to perform gamma debugging on the test sub-pixels in a test display region selected in the first display region to obtain a first gamma data set, wherein the test sub-pixels positionally correspond to sub-pixels in the second display region, the test sub-pixels are part of sub-pixels in the test display region.

The detecting module 63 is configured to control all the sub-pixels in the test display region and all the sub-pixels in the second display region to emit light, and detect a target luminance and a target chrominance of the test display region that correspond to a corresponding grayscale.

The debugging module 62, which is electrically connected to the detecting module 63, is also configured to perform gamma debugging on the second display region, such that at the corresponding grayscale, a luminance of the second display region is the target luminance and a chrominance of the second display region is the target chrominance, and accordingly, obtain a second gamma data set.

The processing module 64, which is electrically connected to the debugging module 62 and the obtaining module 61 respectively, is configured to obtain, based on the second gamma data set, the first gamma data set and the predetermined gamma data set, a third gamma data set applied to the second display region.

The gamma debugging apparatus according to at least one embodiment of the present disclosure is capable of performing gamma debugging for display apparatus including display regions with different pixel arrangements, without accurately aligning the second display region, so as to adjust gamma characteristics of different display regions, so that when the display apparatus operates normally, display information (the display information may include luminance and chrominance, but the present disclosure is not limited thereto) of the first display region is substantially the same as display information of the second display region at the same grayscale.

In a specific implementation, the debugging module can be specifically configured to control the test sub-pixels to light up, and control sub-pixels in the test display region other than the test sub-pixels not to emit light, and adjust analog data voltages provided to the test sub-pixels to perform gamma debugging on the test display region to obtain the first gamma data set.

In at least one embodiment of the present disclosure, the detecting module is also configured to control all sub-pixels in other regions of the first display region than the test display region to emit light while controlling all the sub-pixels in the test display region to emit light, so that the luminance and chrominance of edges within the test display region are uniform.

In a specific implementation, the processing module can be specifically configured to obtain a difference gamma data set based on the second gamma data set and the first gamma data set; and obtain, based on the difference gamma data set and the predetermined gamma data set, the third gamma data set applied to the second display region.

In at least one embodiment of the present disclosure, the debugging module can be also configured to perform gamma debugging on the sub-pixels in the first display region to obtain the predetermined gamma data set.

The gamma debugging apparatus according to at least one embodiment of the present disclosure can be any product or component with display function, such as mobile phone, tablet computer, television, monitor, notebook computer, digital photo frame and navigator.

While the foregoing is directed to optional embodiments of the present disclosure, it will be understood by those skilled in the art that various changes may be made and equivalents may be substituted for elements thereof without departing from the principles of the disclosure, and these changes and equivalents should be deemed as falling in the scope of the present disclosure.

What is claimed is:

1. A gamma debugging method, applied to a display panel, wherein the display panel comprises a first display region and a second display region, and the second display region has a pixel density lower than a pixel density of the first display region, and the gamma debugging method comprises:

obtaining a predetermined gamma data set of the first display region;

selecting a test display region in the first display region, taking part of sub-pixels in the test display region as test sub-pixels, and performing gamma debugging on the test sub-pixels to obtain a first gamma data set by causing the test sub-pixels to light up and sub-pixels in the test display region other than the test sub-pixels not to emit light and adjusting analog data voltages provided to the test sub-pixels, where the test sub-pixels positionally correspond to sub-pixels in the second display region;

controlling all the sub-pixels in the test display region and all sub-pixels in the second display region to emit light, and detecting a target luminance and a target chrominance of the test display region that correspond to a corresponding grayscale;

performing gamma debugging on the second display region, such that at the corresponding grayscale, a luminance of the second display region is the target luminance, and a chrominance of the second display region is the target chrominance, and accordingly obtaining a second gamma data set; and obtaining, based on the second gamma data set, the first gamma data set and the predetermined gamma data set, a third gamma data set applied to the second display region by obtaining a difference gamma data set based on the second gamma data set, the first gamma data set and the predetermined gamma data set.

2. The gamma debugging method according to claim 1, wherein the performing the gamma debugging on the test sub-pixels to obtain the first gamma data set comprises:

controlling the test sub-pixels to light up, and controlling sub-pixels in the test display region other than the test sub-pixels not to emit light; and adjusting analog data voltages provided to the test sub-pixels to perform gamma debugging on the test display region, to obtain the first gamma data set.

3. The gamma debugging method according to claim 1, further comprising:

while controlling all the sub-pixels in the test display region to emit light, controlling all sub-pixels in other regions of the first display region than the test display region to emit light.

4. The gamma debugging method according to claim 1, wherein a maximum distance between an outer edge of the test display region and an outer edge of the second display region is less than a predetermined distance.

5. The gamma debugging method according to claim 1, wherein before the obtaining the predetermined gamma data set of the first display region, the gamma debugging method further comprises:

performing gamma debugging on sub-pixels in the first display region, to obtain the predetermined gamma data set.

6. A gamma debugging apparatus, applied to a display panel, wherein the display panel comprises a first display region and a second display region, and the second display region has a pixel density lower than a pixel density of the first display region, and the gamma debugging apparatus comprises an obtaining circuit, a debugging circuit, a detecting circuit and a processing circuit;

wherein, the obtaining circuit is configured to obtain a predetermined gamma data set of the first display region;

the debugging circuit is configured to perform gamma debugging on test sub-pixels in a test display region selected in the first display region, to obtain a first gamma data set by causing the test sub-pixels to light up and sub-pixels in the test display region other than the test sub-pixels not to emit light and adjusting analog data voltages provided to the test sub-pixels, wherein the test sub-pixels positionally correspond to sub-pixels in the second display region, and the test sub-pixels are part of sub-pixels in the test display region;

the detecting circuit is configured to control all the sub-pixels in the test display region and all the sub-pixels in the second display region to emit light, and detect a target luminance and a target chrominance of the test display region that correspond to a corresponding grayscale;

the debugging circuit is further configured to perform gamma debugging on the second display region, such that at the corresponding grayscale, a luminance of the second display region is the target luminance, and a chrominance of the second display region is the target chrominance, and to accordingly obtain a second gamma data set; and the processing circuit is configured to obtain, based on the second gamma data set, the first gamma data set and the predetermined gamma data set, a third gamma data set applied to the second display region by obtaining a difference gamma data set based on the second gamma data set, the first gamma data set and the predetermined gamma data set.

7. The gamma debugging apparatus according to claim 6, wherein the detecting circuit is further configured to control all sub-pixels in other regions of the first display region than the test display region to emit light while controlling all the sub-pixels in the test display region to emit light.

8. The gamma debugging apparatus according to claim 6, wherein the processing circuit is specifically configured to obtain a difference gamma data set based on the second gamma data set and the first gamma data set, and obtain, based on the difference gamma data set and the predetermined gamma data set, the third gamma data set applied to the second display region.

9. The gamma debugging apparatus according to claim 6, wherein the debugging circuit is further configured to perform gamma debugging on sub-pixels in the first display region to obtain the predetermined gamma data set.

* * * * *